United States Patent [19]

Sakaoka

[11] Patent Number: 4,650,359

[45] Date of Patent: Mar. 17, 1987

[54] MECHANICAL PENCIL WITH AUTOMATIC LEAD ADVANCE

[75] Inventor: Gouji Sakaoka, Tokyo, Japan

[73] Assignee: Pentel Kabushiki Kaisha, Tokyo, Japan

[21] Appl. No.: 727,396

[22] Filed: Apr. 25, 1985

[30] Foreign Application Priority Data

Apr. 27, 1984 [JP] Japan ..... 59-85606
Oct. 2, 1984 [JP] Japan ..... 59-149417
Oct. 2, 1984 [JP] Japan ..... 59-149418

[51] Int. Cl.[4] ..... B43K 21/16; B43K 21/22

[52] U.S. Cl. ..... 401/53; 401/65; 401/67; 401/81; 401/94

[58] Field of Search ..... 401/53, 54, 65, 67, 401/94, 80, 81

[56] References Cited

U.S. PATENT DOCUMENTS

Re. 15,968 12/1924 Waring ..... 401/53
2,184,911 12/1939 Fend ..... 401/65
2,865,330 12/1958 Swank ..... 401/53
4,459,057 7/1984 Hashimoto et al. ..... 401/53
4,478,529 10/1984 Morio ..... 401/94
4,504,163 3/1985 Hashimoto et al. ..... 401/53
4,521,126 6/1985 Sakaoka et al. ..... 401/81
4,538,934 9/1985 Brunner ..... 401/94

FOREIGN PATENT DOCUMENTS 3301546 7/1984 Fed. Rep. of Germany ..... 401/53

*Primary Examiner*—Steven A. Bratlie
*Attorney, Agent, or Firm*—Wenderoth, Lind & Ponack

[57] ABSTRACT

A mechanical pencil having a chuck mechanism which permits the lead to advance but prevents the lead from retracting, a first slider, a second slider which is retractable progressively as a writing pressure is applied, a first engagement device for holding the second slider at its retracted position and a second engagement device for holding the first slider at its retracted position. The progressively retracted second slider is released to advance to the forward original position by applying a further writing pressure to cause a retraction of the first slider. Then, the second slider is advanced forwardly together with the lead so that the lead is advanced to a writing position.

7 Claims, 24 Drawing Figures

MECHANICAL PENCIL WITH AUTOMATIC LEAD ADVANCE

BACKGROUND OF THE INVENTION

The present invention relates generally to an automatic writing instrument which is constructed to feed the writing lead into a writing position merely through application of pressure or thrust against the writing point end of the pencil, or against the writing tip of lead itself. More particularly, the present invention relates to a mechanical pencil of the type described above in which, when a lead portion exposed from the pencil point end is used up, lead is fed into a writing position by merely releasing a small pressure applied against the writing point end without changing the writing posture of the pencil so that the lead is fed to the writing position continuously during a writing operation. The present invention is applicable to an automatic drawing machine.

Many attempts have been made to cause the lead to feed into a writing position without involvement of a special pushing actuation of a button which is generally provided at the rear end of the pencil. Some of these attempts are disclosed in U.S. Pat. No. 4,504,163 issued Mar. 12, 1985 to the present assignee, and such mechanical pencils as described above are generally classified into two types of pencils from the viewpoint of mechanism and operation.

The first type of mechanical pencil is disclosed in U.S. Pat. No. 4,504,163 in which a slider and a chuck mechanism are retracted within the pencil through the lead to a predetermined distance and then these elements are advanced or returned to their original forward position by releasing a pressure which has been applied to the writing point end. At this moment, the slider is held or temporarily suspended at its retracted position and, on the other hand, the chuck mechanism is immediately caused to advance, and thereafter the slider is caused to advance to its original position. By the delayed movement of the slider relative to the chuck mechanism, the lead is fed to the writing position of the pencil.

The second type of pencil is disclosed in Japanese Patent Application No. 59-25906, filed Feb. 14, 1984 by the present inventor, in which the distance of rearward and then forward displacement of the slider is set so as to be greater than that of a chuck mechanism so that the lead can be pulled forwardly out of the chuck when the slider is returned forwardly.

Both the first and second types of the pencil have advantages and provide improvement of the lead-feed operation. Although these pencils produce a reliable lead-feed operation while the pencil is continuously held in a writing posture without a special pushing operation, on the other hand, a relatively large pressure which is greater than a normal writing pressure must be applied and, therefore, continuous writing is interrupted and the relatively large pressure applied to the pencil point end sometimes injures the writing surface of a paper. In order to overcome such a disadvantage, an attempt has been made to use springs of smaller spring force so that a relatively small force substantially equal to a normal writing pressure can provide a lead feed operation, but this causes a new problem that the lead is projected as writing pressure is applied.

SUMMARY OF THE INVENTION

An object of the present invention is to provide an improved automatic mechanical pencil which is constructed to fed the lead to a projected writing position by accumulating writing pressure within the pencil by holding a slider at progressively retracted positions until its retraction is limited, so that the lead is not projected every time a writing pressure is applied and released, to thereby prevent an undesired projection of the lead.

Another object of the present invention is to provide an improved mechanical pencil, which allows continuous writing by pushing a lead guide tube against the paper even when the lead is worn out or broken so that its end is flush with the projected end of the lead guide tube.

Another object of the present invention is to provide a new mechanical pencil which produces an automatic lead feed operation such that succeeding leads can be fed to a writing position without manipulation of a pushbutton.

Briefly, the mechanical pencil according to the present invention has, basically, a chuck mechanism which permits the lead to advance but prevents the lead from retracting, an axially movable first slider, a second slider which is resiliently biased by a spring in a forward direction and retractable progressively as a writing pressure is applied, a first wedging or engagement device for holding the second slider at its retracted position, and a second wedging or engagement device for holding the first slider at its retracted position. The progressively retracted second slider, which has been held at its retracted position, is released by forcibly retracting the first slider. Then the second slider is advanced together with the lead by the force of the spring so that the lead is advanced to a writing position.

In a preferred embodiment of the present invention, the aforementioned first engagement device is formed by an inclined guide surface on an inner wall surface of the tubular casing of the pencil, rotary elements mounted on the first slider and a forward outer surface of the second slider, and, the second engagement device is formed by an inner surface of the tubular casing, separate rotary elements mounted on a rear portion of the first slider and a movable cylindrical body which is positioned between the first and second sliders such that it is biased rearwardly and which has an inclined portion on its outer surface. The first spring is disposed between the first slider and the cylindrical body, and the second spring is disposed between a spring receiver of the tubular casing and the second slider.

In another embodiment of the invention, a third slider is provided at the forward position of the second slider. The third slider has a rearwardly spring-biased lead guide tube projecting from the tubular casing. When the lead is not projected from the guide tube but is worn out so as to be flush with the projecting end of the lead guide tube, a writing pressure applied to the lead guide tube and the third slider forcibly retracts the second slider and the chuck which has the lead engaged therein. Upon release of the writing pressure, the chuck body is advanced along with the lead engaged therein while the second slider is retained at its retracted position. This structure permits a regular lead-free operation even when the lead is not projected from the lead guide tube of the pencil.

In a further embodiment of the invention, a pencil has a single slider which can be retracted by a writing pressure, and a chuck mechanism which permits a forward movement of the lead but prevents its retraction. The chuck has a chuck holder which travels along with the chuck. A rearwardly spring-biased cylindrical body having an inclined surface is provided outside the slider so that the inclined surface is contacted by rotary elements which are rotatably held by the slider. The chuck holder has a forward projection which contacts the rotary elements so that a wedge function can be produced by, in combination, the cylindrical body. When the retracted slider is returned forwardly by releasing the writing pressure, the chuck holder is accompanied in its forward movement by the slider so that the chuck is advanced and opened for receiving the following or succeeding lead. The chuck holder may be fixed at its rearward end to a rearward end of the chuck which is rearwardly spring-biased by a chuck-spring, and alternatively, the chuck-spring can be omitted and a chuck-holder of a ring-shape positioned at a forward portion of the chuck and be rearwardly spring-biased so that it is resiliently contacted with the forward end of the chuck.

PREFERRED EMBODIMENTS OF THE INVENTION

Figure 1A:
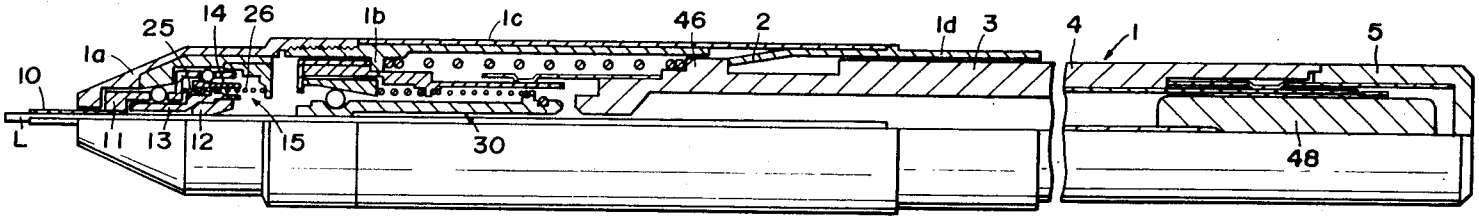
FIGS. 1A through 7 are sectional views of one embodiment of the mechanical pencil of the present invention showing, in turn, an operational mode and movement of pencil elements, wherein two sliders are shown.

Referring to the drawings, like reference numerals represent like parts in the different and various views of the drawings, wherein the rearward end portion and longitudinal half portion are not illustrated, the structure thereof being understood from the known mechanical pencil as well as from the following description.

Figure 1B:
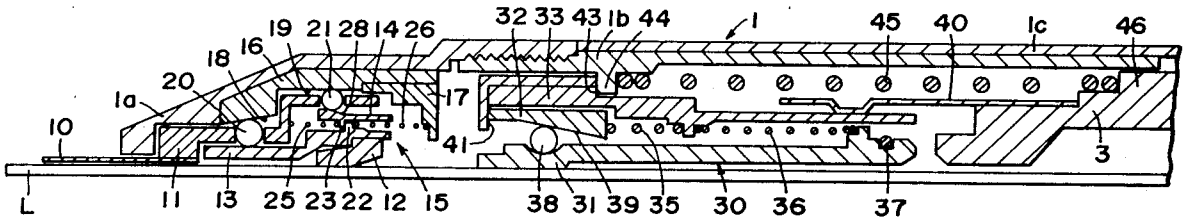

Referring first to FIGS. 1A through 7, particularly FIGS. 1A and 1B, a tubular casing 1 for the pencil has a conical member 1*a*, a forward part 1*b* engaged with the conical member 1*a*, a middle part 1*d* connected to the forward part 1*b* through an outer part 1*c*, a rearward part 4 which is engaged with a front inclined portion of the middle part 1*d* and has a lead chamber 3, and an end cap 5 releasably fitted to a rear end of the rearward part 4.

Within the tubular casing 1 there is provided a lead-feed actuator 15 which has a first slider 11 having a lead guide tube 10 projecting from the conical member 1*a*, a second slider 13 which is positioned inside the first slider 11 and has a lead retainer 12 of desired resilient materials, which is designed to function to resist reverse movement of a lead during slider retraction and to aid the advancing movement of the lead when the slider advances or travels in the forward writing point end direction. In addition, the lead-feed actuator 15 comprises a cylindrical body 14 between the first slider 11 and the second slider 13, and a chuck mechanism 30 is provided at the rear portion of the actuator 15.

First, the lead-feed actuator 15 will be explained. As illustrated in FIG. 1B, on the inner surface of the conical member 1*a* is fixed a receiver member 16 for receiving rotary elements which will be described presently, and an abutment member 17 is fixed to a rear portion of the receiver member 16. The receiver member 16 has an inclined guide surface 18 at its forward portion and a straight cylindrical portion 19 at the rear portion, the flat portion 19 having greater diameter than the forward inclined guide surface 18, these portions 18 and 19 being contacted by the rotary elements mounted on the first slider 11.

The first slider 11, which has the lead guide tube 10 and is axially movable, has a forward portion of smaller diameter and a rearward portion of larger diameter. The forward portion has holes for rotatably holding first rotary elements 20, only one being illustrated, and similarly the rearward portion has holes for rotatably holding second rotary elements 21, only one being illustrated, the holes of each group being formed at regular circumferential intervals.

The second slider 13 which has the annular shaped lead retainer 12 of resilient materials is axially movably disposed inside the first slider 11, and a forward straight cylindrical portion of the second slider 13 is contacted with the first rotary elements 20 to provide a "wedge" effect in combination with the inclined guide surface 18 of the receiver member 16. Reference numeral 22 designates an annular projection or lug formed on the rearward larger-diameter portion of the second slider 13.

Between the rearward larger-diameter portion of the first slider 11 and the rearward larger-diameter portion the second slider 13, the cylindrical body 14 is axially movably positioned. The cylindrical body 14 is provided with an annular projection or lug 23 for contacting the lug 22 of the second slider 13, and is biased rearwardly by a first spring 25 which is disposed between the first and second sliders 11, 13.

A second spring 26 is disposed between the second slider 13 and the abutment member 17 to bias the second slider in the forward direction. Since the spring force of the second spring 26 is larger than that of the first spring 25, the second slider 13 and the cylindrical body 14 are biased in the forward direction against the force of the first spring 25, but the second slider 13 is held in position by the wedging effect produced by, in combination, the first rotary element 20 and the inclined guide surface 18 and, therefore, the forward movement of the second slider 13 is interrupted. By the spring force of the first spring 25, the cylindrical body 14 is held or suspended at the position illustrated in FIG. 2, and a wedge effect is produced by, in combination, the portion 19 of the receiver member 16, the second rotary element 21 and the inclined surface 28 of the cylindrical body 14. Namely, in the initial stage illustrated in FIGS. 1A and 1B wherein the lead is projected to a writing position by pushing a rearward part 4 forwardly, the forward movement of the cylindrical body 14 is limited since the forward cylindrical portion of the second slider 13, the first rotary element 20 and the inclined guide surfce 18 constitute the wedge mechanism. Thus, in this stage the second slider 13 can be retracted but its forward returning is restricted, and the second spring 26 does not function to push the cylindrical body 14 but, on the contrary, the cylindrical body 14 is located in the illustrated, balanced position by the spring force of the first spring 25.

At the rear of the lead-feed actuator 15 as described above, the chuck mechanism 30 is axially movably disposed within the tubular casing 1. The chuck mechanism 30 may have a similar structure to those of the known device such as a collet chuck device, ball-chuck device, etc. and any type of chuck mechanism can be used if the lead grasping force is produced by a cooperation of rotary elements 38, inclined surface 39 of a chuck actuator 32 and a collet or chuck 31, and if the chuck 31 is closed in a general state by a spring device for biasing the chuck 31 rearwardly and the chuck actuator 32 forwardly. In the illustrated embodiment, the chuck 31 is composed of a pair of collet pieces in a confronting relation and a rubber ring 37 fitted to the rear end portion of the confronted collet pieces so that the chuck 31 is generally opened. In addition, the chuck mechanism 30 has a tube 33, which is located outside the chuck actuator 32 and frictionally engaged at its rear end with the lead chamber 3 through a pusher 40, a spring 35 between the chuck actuator 32 and the tube 33 which biases the chuck actuator forwardly, and a chuck spring 36 which is positioned between the tube 33 and the chuck 31 to bias the chuck 31 rearwardly. Further, the spring 35 has a greater spring force than the chuck spring 36 and, accordingly, the chuck actuator 32 having an inclined surface 39 is contacted with an abutment portion 41 of the tube 33 in the general condition and, on the other hand, the tube 33 is biased rearwardly so that its shoulder 43 is contacted with the stopper 44 on the forward part 1*b* of the tubular casing 1. Between the stopper 44 and the lead chamber 3 is disposed a spring 45 to rearwardly bias the rearward part 4 and the lead chamber 3, but a shoulder 46 of the rearward part 4 abuts against the inwardly inclined portion 2 of the middle part 1*d* to limit the rearward movement of the rearward part 4 and prevents the part 4 from releasing from the tubular body of the pencil. In FIG. 1A, reference numeral 48 designates an eraser unit which is mounted on the rear end of the rearward part 4 and can be used by detaching the end cap 5.

The operation of the mechanical pencil according to the first embodiment of the invention will be described with reference to FIGS. 2 to 7.

Figure 2:
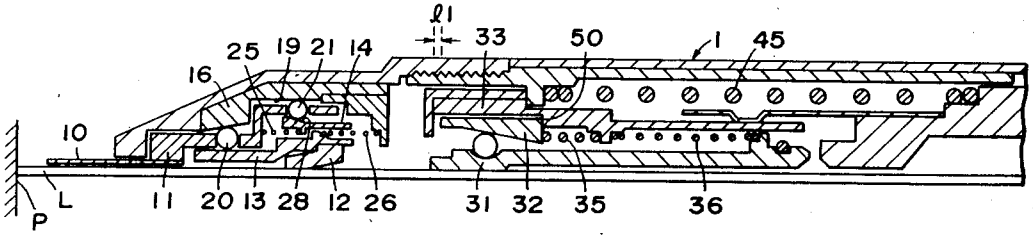

FIG. 2 shows a writing state in which the lead L is projected as shown in FIGS. 1A and 1B and contacts a paper for writing purposes. At this moment, the second slider 13, which has the lead retainer 12 exhibiting a greater frictional force against the lead than the spring force of the second spring 26, is retracted and, at the same time, the chuck 31 is retracted along with the chuck actuator 32 through the distance $l_1$ until it abuts against the shoulder 50 of the tube 33. The spring 35 which resists the retracting force (namely, writing pressure) is adjusted such that its spring force is smaller than a normal writing pressure, that is, about 280 g. Retraction of the second slider 13 and the chuck 31 in this stage of FIG. 2 is limited to 0.3 mm or less and, accordingly, the user of the pencil does not have an unpleasant feeling due to excessive retraction of the elements and the lead during the writing operation. At this moment, the tube 14 is still held in the position illustrated in FIG. 2 regardless of the retraction of second slider 13 since a wedge function is produced among the cylindrical portion 19 of the receiver member 16, second rotary element 21 and the cylindrical body 14 by means of the first spring 25.

Figure 3:
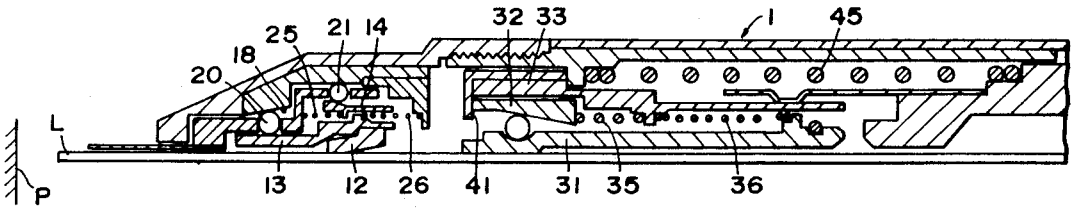

FIG. 3 shows the next stage in which the pencil is lifted up from the paper P so that the lead L is spaced from the paper P. For example, when a character formed by three strokes, for example the alphabetical character E, is to be written, the first stroke which is a lateral straight line "—" is completed and then the pencil tip is spaced from the paper for the next stroke which is "L". In this stage, it is anticipated naturally that the lead L is worn relative to the stage of FIG. 2. When the pencil is spaced from the paper, the writing pressure is released and the chuck 31 is advanced grasping the lead L therein by a spring force of the spring 35 until it contacts the abutment portion 41. On the other hand, the second slider 13 which has retracted the distance equal to the distance $l_1$ (FIG. 2) is held at its retracted position since a wedge function is produced among the rotary element 20, inclined guide surface 18 and the second slider 13 by the first spring 25, the wedging function or engagement force being stronger than the spring force of the second spring 26. At this moment, the lead L is advanced along with the chuck 31 by the spring force of the spring 35 as described above and, accordingly, the lead L is returned to its original position except for the length of worn lead. Accordingly, at the stage of FIG. 3, wherein the first stroke of "E" is completed, all the chuck 31, chuck actuator 32 and lead L are returned to their original position except for the second slider 13, which is sustained at its retracted position.

Figure 4:
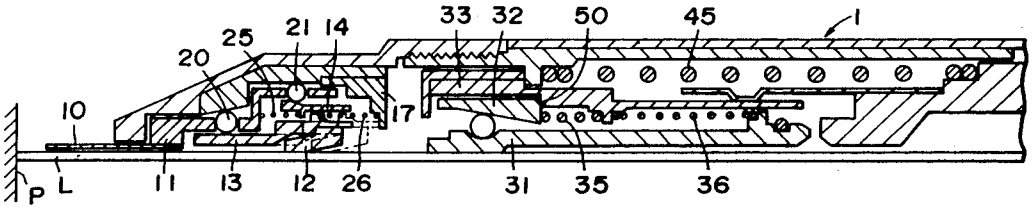

FIG. 4 shows the next stage wherein the second stroke for the three-stroke character E is to be made and the pencil is lowered so that the lead contacts the paper P. At the stage of FIG. 4, all the lead L, second slider 13 having the lead retainer 12, chuck 31 grasping the lead L firmly and chuck actuator 32 are again retracted until the chuck actuator 32 abuts against the shoulder 50 of the tube 33. Accordingly, it is anticipated that the second slider 13 has now retracted a distance twice the previous retracting distance (equal to $l_1$ of FIG. 2). At this moment, the cylindrical body 14 is still held in the position so that it is not retracted at all because a wedge function is produced similar to that in the stage of FIG. 2. When the writing pressure is released for the final stroke, that is, a middle bar "—" of the "E", the second slider 13 is held at a further retracted position so that retraction thereof is accummulated, but the lead L returns to the original position along with the chuck 31 against the frictional resistance of the lead retainer 12.

By repetition of the operation described above, the second slider 13 continues to retract every time a writing pressure is added until it abuts against the abutment member 17. By contrast, the chuck 31, chuck actuator 32 and lead L are repeatedly retracted and then returned to their advanced position as a writing pressure is added, regardless of the rearmost position of the second slider 13.

Figure 5:
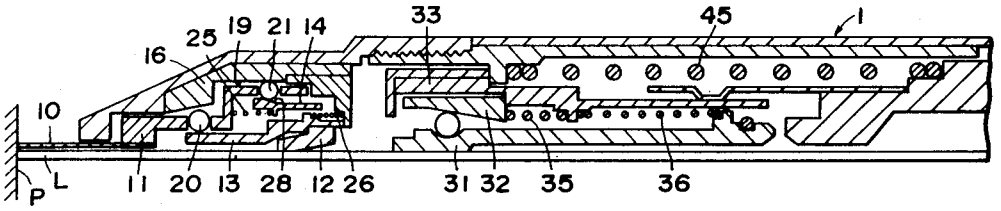

Now, if writing is continued when the second slider 13 is located at the rearmost position as described until the lead is worn up to the end of the lead guide tube 10, and then if a writing force is applied for a further writing operation, the first slider 11 having the lead retainer 10, which contacts the paper P, is retracted and, at this moment, the lead as well as the chuck 31 and chuck actuator 32 are simultaneously retracted, FIG. 5. As illustrated in FIG. 5, the cylindrical body 14 which has been held still is also retracted by the spring 25 along with the first slider 11 for the same distance as the retracted distance of the first slider 11 until a wedge function is again produced among the flat portion 19 of the receiver member 16, the second rotary element and the inclined surface 28 of the cylindrical body 14. The writing at this stage is conducted by placing both the lead end and the lead guide tube 10 into contact with the paper P, and a smooth writing operation can be established similar to the case when only the lead contacts the paper since the spring force of the first spring 25 is set to be extremely small. Besides, at the retracting movement of the first slider 11, the wedge function of the first rotary element 20 is released for permitting the second slider 13 to move in the forward direction under the action of the spring 26, but actually the second slider 13 is not advanced because the chuck 31 is retracted a maximum distance to firmly hold the lead with a greater force than the spring force of the second spring 26, and because the spring force of the second spring 26 is smaller than the frictional engagement force of the lead retainer 12.

Figure 6:
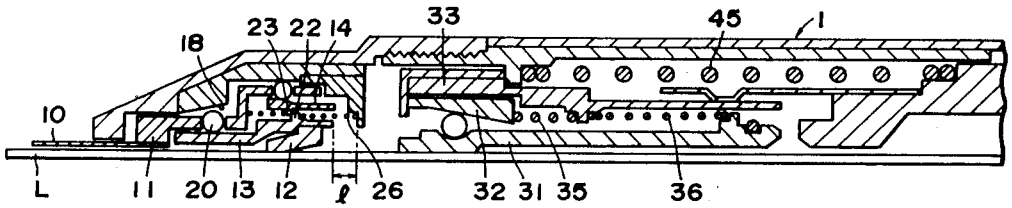
Figure 7:
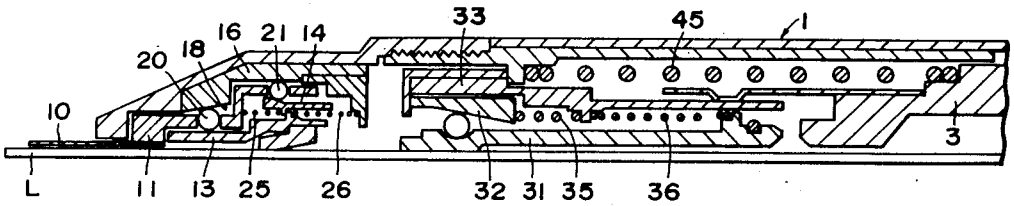

FIG. 6 shows a stage in which the writing pressure added in the stage of FIG. 5 is released. When the writing pressure is released, the chuck 31, chuck actuator 32 and Lead L are returned to their original forward position by the spring force of the spring 35. This is the state in which the chuck 31 permits the lead to be advanced and, accordingly, the second slider 13 advances with the lead engaged therein and accompanied by the lead retainer 12 of the slider 13. At this moment, the first slider 11 held at its retracted position due to the wedge function of the three elements 19, 21, 28, and the wedge function among the first rotary element 20, inclined guide surface 18 and the second slider 13 is released, and then the forward movement of the second slider 13 is not interrupted at all. The second slider 13 is advanced and the lead is pulled out of the chuck 31 until the lug 22 of the second slider 13 abuts against the lug 23 of the cylindrical body 14, and this advancing distance is designated as "1" which corresponds to an increment of the lead projected from the lead guide tube 10. By the abutment of the lugs 22 and 23, the cylindrical body 14 is slightly advanced by the spring force of the second spring 26, which is larger than that of the first spring 25, to thereby release the wedge function of the second rotary element 21. Accordingly, the second slider 13 advances and at that same time pulls the lead out of the chuck 31, with the positional relation of the first slider 11, second slider 13, rotary elements 20, 21 and the cylindrical body 14 being maintained unchanged. Then, as shown in FIG. 7, the forward movement of the second slider 13 is limited at the position where a wedge function is produced among the inclined guide surface 18 of the receiver member 16, first rotary element and the forward reduced-diameter portion of the second slider 13. Thus, a lead advancing operation is completed.

The foregoing is the operation for advancing the lead which already projected from the lead guide tube 10, when such a projecting portion of the lead is worn out or used up, by pushing with a writing pressure the writing point end against the paper and releasing the writing pressure. The first operation for advancing one of the leads in the lead container or chamber in the pencil body into a writing position (FIG. 1A) is made in a general manner by pushing the rear end cap or push-button into the pencil body similar to the operation disclosed in the aforementioned U.S. Pat. No. 4,504,163. Briefly, the entire chuck mechanism 30 is advanced with the lead engaged therein by forcibly advancing the rearward part 4 which has a lead chamber 3 by manipulation of the push-button and then the rearward part 4 is further advanced to open the chuck 31 to permit one lead among leads in the lead chamber 3 to drop into and through the chuck 31. By repeated manipulation of the push-button, the lead is forced to advance into the lead retainer 12 and to project from the lead guide tube 10 or writing point by a length necessary for writing as illustrated in FIGS. 1A and 1B.

In the embodiment of FIGS. 1A through 7, the first slider 11 is retracted by contacting the lead guide tube 10 to unlock the second slider 13 which has been locked or held at position by the wedge function of the first rotary element 20.

Figure 8:
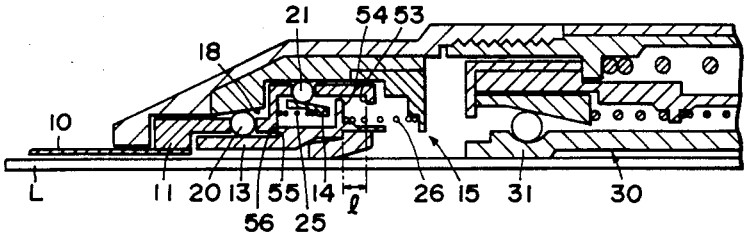
FIGS. 8 through 11 are sectional views of another embodiment of the pencil of the present invention showing an operational mode and movement of pencil elements.

FIG. 8 shows a second embodiment of the invention in which it is not necessary to place the lead guide tube 10 into contact with the paper in order to unlock the second slider 13. In the embodiment of FIG. 8, the second slider 13 which contacts the first rotary element 20 similar to the structure of the previous embodiment has a projection 54 on its rearward portion, and the first slider 11 has an inward projection 53 on its rear end such that the projections 53 and 54 are in a spaced confronting relation at a distance "1". The second slider 13 and the first slider 11 have shoulders 55 and 56, respectively, and the shoulders 55, 56 are generally contacted with each other as shown in FIG. 8. The second slider 13 is locked by the wedge function of the first rotary element 20 so that its forward movement is interrupted, and the cylindrical body 14 which is biased rearwardly by the first spring 25 provides a wedge function in combination with the second rotary element 21. Namely, in the initial stage of operation shown in FIG. 8, in which the lead is projected by manipulation of the push-button (not shown), the second slider 13 is capable of retracting for the distance "1" until its projection 54 abuts against the inward projection 53 of the first slider 11, but incapable of returning to the original forward position. Other structural features of the lead-feed actuator 15 and of the chuck mechanism 30 can be considered to be substantially similar to those of the previous embodiment of FIGS. 1A through 7.

Figure 9:
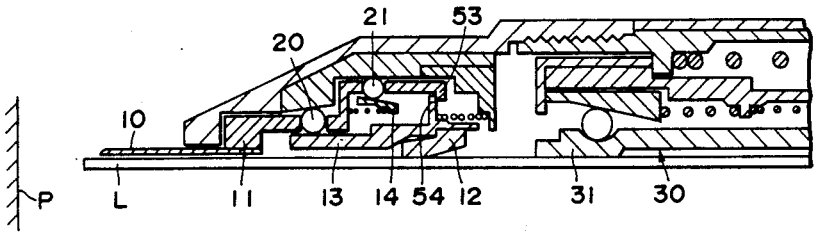
Figure 10:
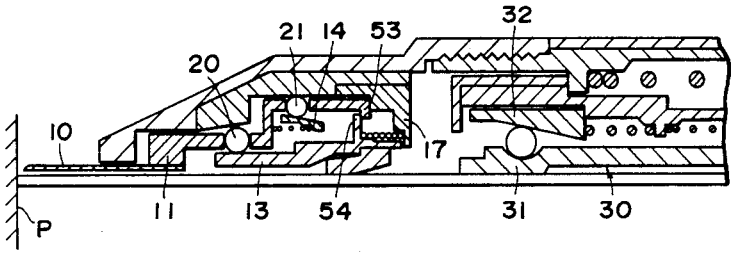
Figure 11:
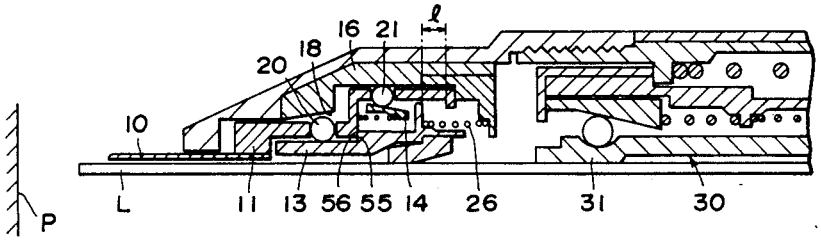

The operation of the structure shown in FIG. 8 will be explained with reference to FIG. 9 through 11. FIG. 9 shows the stage in which the pencil is lifted up and spaced from the paper after a writing operation. In this stage, the second slider 13 is progressively retracted as writing pressure is added repeatedly, and locked by the wedge function of the first rotary element 20, at the position where the projection 54 contacts or almost contacts the inward projection 53 of the first slider 11. If a writing operation is conducted again as illustrated in FIG. 10, all the lead L, chuck 31 and the chuck actuator 32 are retracted along with the second slider 13, which pushes back the projection 53 of the first slider 11 and, accordingly, the first slider 11 is also retracted until it abuts against the abutment member 17. In order to provide this movement of the elements, it is necessary that the frictional force of the lead guide tube 12 be greater than the sum of the wedge-engagement force of the second rotary element 21 and the spring force of the second spring 26. Since the locking of the second slider 13 by the first rotary element 20 is released by retraction of the first slider 11, the wedge function of the second rotary element is again produced, as shown in FIG. 11, if the pencil is spaced from the paper P, and the first slider 11 is held at its retracted position. At this moment, the second slider 13 takes the lead out of the chuck 31 and simultaneously travels forwardly for the distance "l" until its shoulder 55 is contacted with the shouder 56 of the first slider 11 so that the lead is projected for the length "l" from the lead guide tube 10. In the stage of FIG. 11 in which both the first and second sliders are contacted at the shoulders 55 and 56, the spring force of the second spring is added to the first slider 11. Since the spring force of the second spring 26 is greater than the wedge function of the second rotary element 21, the positional relation among the first and second sliders 11, 13, rotary elements 20, 21 and the cylindrical body 14 is maintained unchanged, and the second slider 13 pulls the lead L out of the chuck 31 and at the same time travels forwardly until the wedge function is produced by the first rotary element 20.

Figure 12:
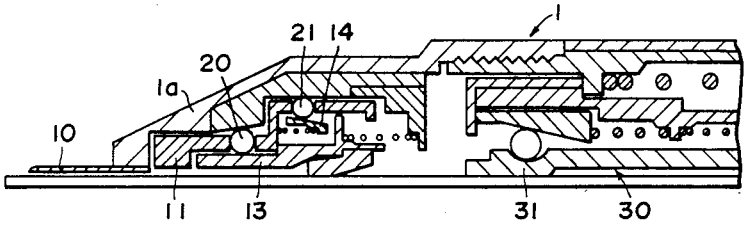
FIG. 12 is a sectional view of a modified structure of the pencil, in which a lead guide tube is immovable and fixed to the pencil casing.

In both the first embodiment of FIGS. 1A through 7 and the second embodiment of FIGS. 8 through 11, the lead guide tube 10 is connected to the first slider 11. However, in the structure of the second embodiment of FIGS. 8 through 11, the lead guide tube 10 can be fixed to the conical member 1a of the tubular casing 1 as shown in FIG. 12 to prevent the lead from advancing unexpectedly if the first slider 11 is unexpectedly retracted when a ruler or template is used in the writing operation. If necessary, in order to recognize or visually examine the time when the lead-feed actuation starts, the lead guide tube 10 can be connected to the second slider 13 so that the lead guide tube 10 is retracted during the retraction of the second slider as writing pressure is added.

Figure 13:
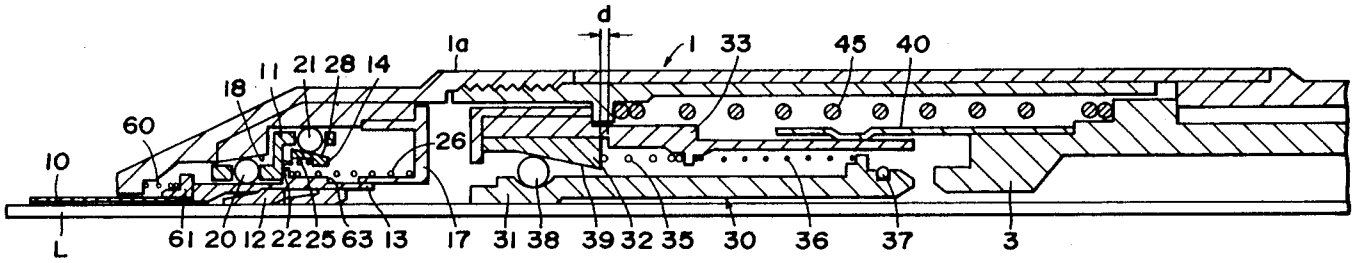
FIGS. 13 through 16 are sectional views of a further embodiment of the pencil according to the present invention showing a structural feature of the pencil and an operational mode and movement of pencil elements, wherein three sliders are shown.

FIGS. 13 through 16 show a further embodiment of the invention which comprises an additional or third slider 61. In FIG. 13, a first slider 11, which holds a first rotary element 20 at its forward small-diameter portion and a second rotary element 21 at its rearward large-diameter portion, is axially movably positioned and a second slider 13 is provided inside the first slider 11 such that the second slider 13 is biased forwardly by a spring 26 mounted between a lug 22 of the slider 13 and an abutment member 17. The second slider 13 has a lead retainer 12 and a shoulder 63 which contacts the abutment member 17 to limit the retraction. At the forward position of the second slider is provided the third slider 61 having a lead guide tube 10 which is generally contacted with a forward end of the second slider 13, the third slider being axially movable. Between the second rotary element 21 of the first slider 11 and the second slider 13, there is provided an axially movable cylindrical body 14 which is biased rearwardly relative to the first slider 11 by a spring 25 and has an inclined surface 28 for contacting with the second rotary element 21.

Figure 14:
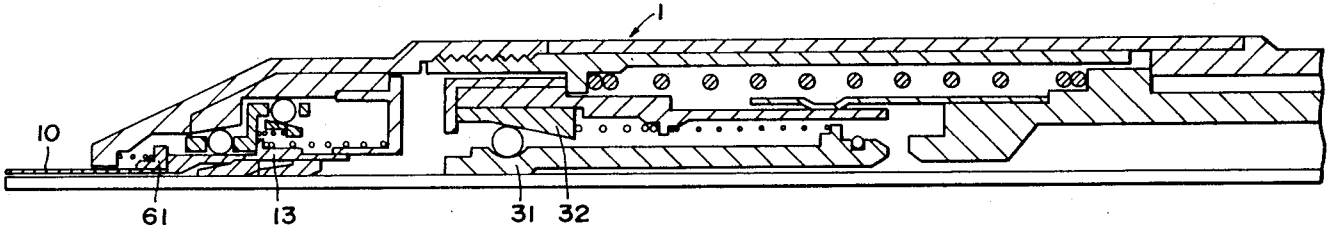

Operation of the pencil in the embodiment of FIG. 13 will be described with reference to FIGS. 14 to 16. When the lead guide tube 10 is pushed against the paper for the purpose of writing in the state that the lead is not projected from the lead guide tube 10 as shown in FIG. 14, the second slider 13 is pushed rearwardly by the third slider 61, and the chuck 31 is also retracted for the distance "d" of retraction of the chuck actuator 32 since the lead in this stage contacts the paper P, FIG. 15.

Figure 15:
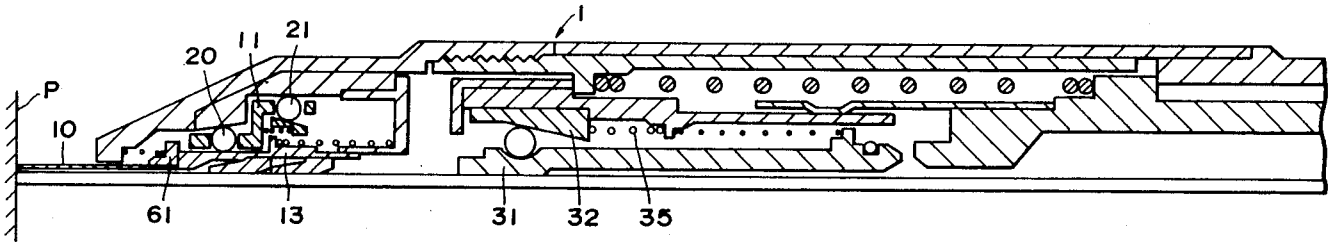
Figure 16:
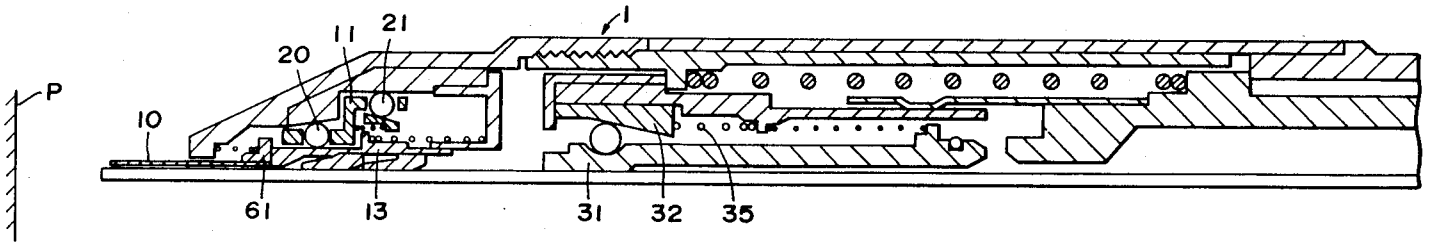

When the pencil is lifted up so that the lead guide tube 10 is spaced from the paper P in the state of FIG. 15, the chuck actuator 32 is advanced by the spring force of the spring 35 and, accordingly, the lead engaged by the chuck 31 is advanced for the same distance. By the forward displacement of the lead, a forward thrust is added to the second slider 13 which, however, is locked by the wedge function of the first rotary element 20 with respect to its forward displacement and, accordingly, the second slider 13 does not move in the forward direction, and held still at its retracted position. Therefore, the lead is projected from the lead guide tube for the length substantially equivalent to the difference or distance of displacement of the two elements. Thus the lead is projected into the writing position as illustrated in FIG. 16.

In the embodiment of FIGS. 13 through 16, even when the lead is used up and its point is flush with the lead guide tube 10, the position of the first slider 11 is maintained unchanged whereas the second and third sliders 13, 61 can be moved rearwardly by pushing the lead guide tube 10 against the paper surface and then locked or held at their retracted position. By a single manipulation of pushing the lead guide tube 10 against the paper, the lead is projected from the lead guide tube for the length which corresponds to the retracted distance of the chuck 31. Thus, a writing operation becomes possible. Further, even if the third slider 61 is pressed, a release of the wedge function of the first rotary element 20 is not possible until the third slider 61 contacts the first slider 11 and, accordingly, the lead is not projected unexpectedly when a ruler or template is used for writing.

Figure 17:
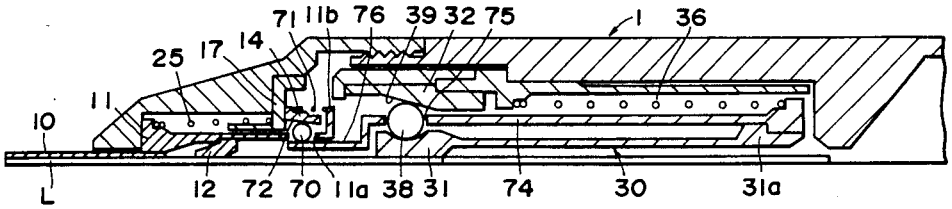
FIGS. 17 through 21 are sectional views of another embodiment of the mechanical pencil according to the invention showing the structure which permits a succeeding lead to immediately and automatically follow the previous lead without manipulation of a push-button or the like, FIG. 22 is a sectional view of a modification of the pencil illustrated in FIG. 17.

FIGS. 17 through 21 show a further embodiment of the invention which, when the retracted slider is returned to its forward original position, permits the chuck which has been closed to be opened so that the following or succeeding leads are continuously fed into and through the chuck without manipulation or actuation of a push button which is generally disposed at the rear end of the pencil. In FIG. 17, the pencil has a single slider 11 having a lead guide tube 10 and a lead retainer 12, biased forwardly by a spring 25. At the rearward portion of the slider 11, a chuck mechanism 30 is provided which has a chuck 31, chuck actuator 32, chuck spring 36 and a plurality of rotary elements 38. Similar to the structure of the previous embodiments, the chuck mechanism functions such that when the chuck 31 is retracted, the chuck 31 is closed to firmly hold the lead therein.

In FIG. 17, the slider 11 has holes **11*a* for rotatably holding rotary elements 70, only one being shown for simplification only, and an outwardly extended portion or a flange 11*b*, and a cylindrical body 14 which has an inclined surface 72 so that it contacts the rotary element 70. The cylindrical body 14 is biased forwardly by a spring 71 one end of which is supported by the flange 11*b*. Outside the chuck 31 is disposed a chuck holder 74 which is fixed at its rear end to the rear end 31*a* of the chuck 31. The chuck holder 74 is cylindrical and has a plurality of holes 75 for the rotary elements such as balls 38. The chuck holder has a forward projection 76 of reduced diameter which contacts the rotary element 70** which is rotatably supported by the slider 11 so that a wedge function can be produced by, in combination, the rotary elements 70, cylindrical body 14 and the chuck holder 74. Thus, when the slider 11 which has been retracted by a writing pressure is returned to the forward position when the writing pressure is released, the slider 11 is advanced accompanying the chuck holder 74 by the aforementioned wedge function and, accordingly, the chuck 31 itself is advanced simultaneously. Thus, the chuck 31 is opened to permit the following or succeeding lead to pass through the chuck 31.

The operation of the pencil in the embodiment of FIG. 17 will be explained with reference to FIGS. 17 through 21. In FIG. 17, the slider 11 is located at its forwardmost position and, on the other hand, the chuck 31 is located at its rearward, lead-engaging position so that the pencil is capable of writing. In this state, the cylindrical body 14 is contacted at its forward end to the abutment member 17 of the casing 1, and the rotary element 70 is not locked and, accordingly, there is no wedging effect on to the forward projection 76.

Figure 18:
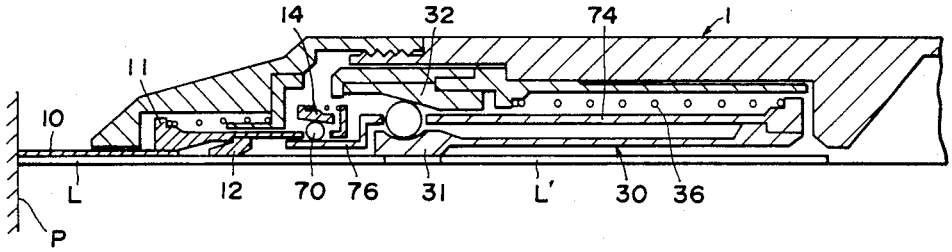

In FIG. 18 showing a writing operation, the slider 11 is retracted as the lead is worn or shortened through writing. With respect to retraction of the slider 11, the frictional resistance produced by the cylindrical body 14 and rotary element 70 is small enough not to interrupt a retraction of the slider 11, and the slider 11 can be retracted smoothly together with the cylindrical body 14.

Figure 19:
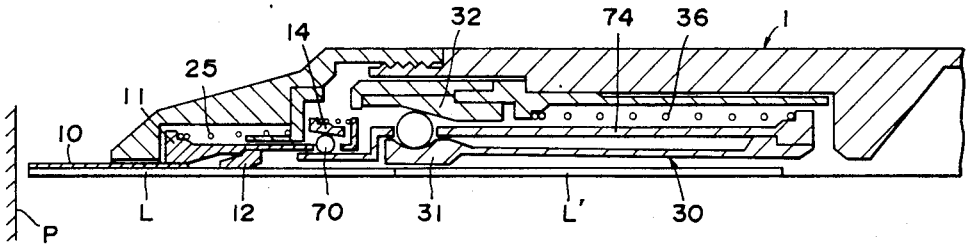

Referring next to FIG. 19 showing that the pencil is lifted up so that the writing point end is spaced from the paper, the slider 11 which has been retracted by the writing pressure is returned to its forward position along with the chuck holder 74 and the chuck body 31, since the frictional resistance produced by the wedge function by the rotary element 70 and the cylindrical body 14 is larger than the spring force of the chuck spring 36 which biases the chuck rearwardly. Thus, the retracted slider 11 is moved in a forward direction by means of the spring 25, and the chuck 31 is opened to release the lead L so that the following or succeeding lead L′ can completely follow the first-mentioned lead L, as shown in FIG. 19.

Figure 20:
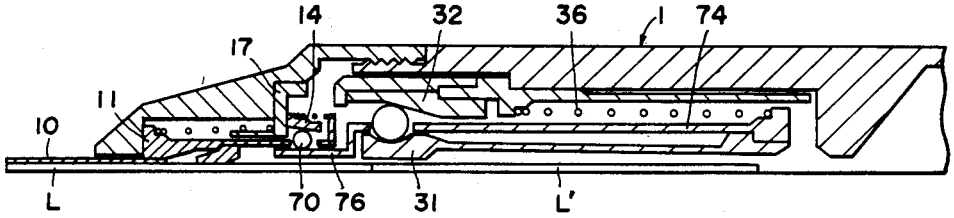
Figure 21:
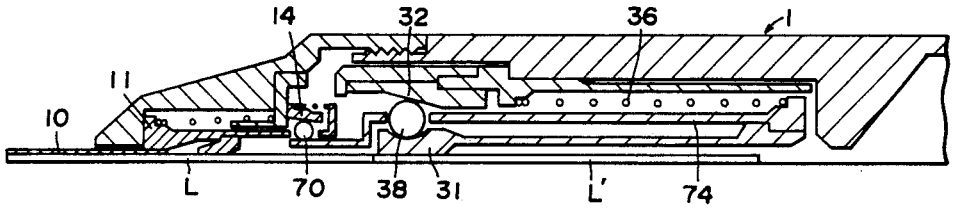

Thereafter, the slider 11 is further advanced to abut against the wall of the tubular casing, as illustrated in FIG. 20. At this moment, the wedge-engagement produced among the cylindrical body 14, the rotary element 70 and the forward projection 76 of the chuck holder 74 is released and, accordingly, the chuck 31 and the chuck holder 74 are retracted by the spring force of the chuck spring 36. Thus, the chuck is closed to hold the lead firmly again, as shown in FIG. 21.

Figure 22:
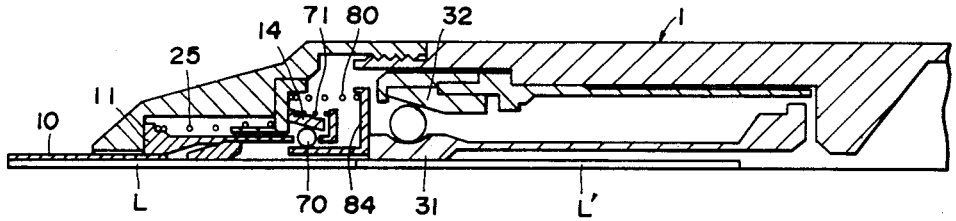

FIG. 22 shows a modification of the pencil in the embodiment of FIGS. 17 through 21. In this modified structure a chuck holder 84, which corresponds to the chuck holder 74 in the previous embodiment of FIG. 17, is positioned at the forward part of the chuck 31 and spring-biased rearwardly to contact the chuck 31 by means of a spring 80, and a spring, which corresponds to the chuck spring 36 in the embodiment of FIG. 17 for biasing the chuck rearwardly, is omitted in this embodiment. In place of the chuck spring of FIG. 17, a separate spring 80 and the chuck holder 84 are positioned to provide a similar effect. In the modified structure of FIG. 22, a forward displacement or returning of the chuck 31 is caused by gravity or by its own weight.

Figure 23:
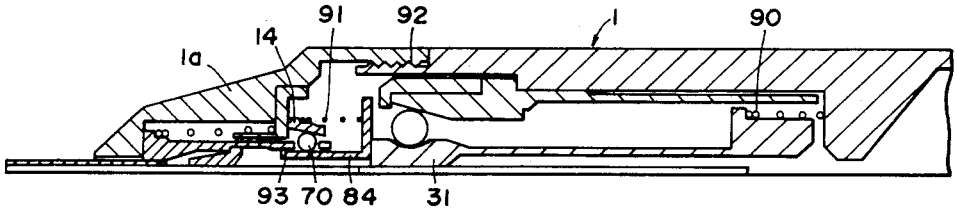
FIG. 23 shows a further modification of the pencil illustrated in FIG. 17.

In order to facilitate the forward displacement of the chuck 31, a spring 90 having a relatively small spring force is mounted between a rear end of the chuck 31 and the inner wall of the tubular casing 1, as illustrated in FIG. 23, and a separate spring 91 which has a larger spring force than the spring 90 is mounted between the cylindrical body 14 and the chuck holder 84, in place of the aforementioned two springs 71, 80 in FIG. 22. Besides, as shown in FIG. 23, if the conical member 1*a* of the tubular casing 1 is separable at a portion shown by reference numeral 92, an annular projection 93 is formed at the forward end of the chuck holder 84 in such a manner that the projection 93 can be engaged with the rotary element 70 so that the chuck holder 84 does not drop from the assembly when the tubular casing 1*a* is separated at 92.

Although the present invention has been described with reference to the preferred embodiments thereof, many modifications and alterations can be made within the spirit of the invention. For example, although the embodiment of FIGS. 17 through 21 including its modifications (FIGS. 22 and 23) has only a single slider, the structural feature thereof can be applied to the two-slider pencil of FIGS. 1 through 12 and the three-slider pencil of FIGS. 13 through 16.

What is claimed is:

1. A mechanical pencil comprising:

a tubular casing means;

a chuck mechanism reciprocally axially movably mounted within said tubular casing means for causing a writing lead engaged therein to feed forwardly toward a writing tip of the pencil and preventing the lead from retracting into said tubular casing means;

slider means axially slidably mounted within said tubular casing means between said chuck mechanism and said writing tip, said slider means having a first slider and a second slider coaxially mounted inside said first slider, said second slider having a lead retainer for frictionally holding the lead therein against retracting movement, and limit means for limiting the rearward retraction of said second slider;

a first wedge-engagement means engageable with said second slider for holding said second slider at its retracted position each time said second slider is retracted such that said second slider is retracted progressively and held each time writing pressure is applied to the lead until said second slider reaches said limit means, said first wedge-engagement means being released upon retraction of said first slider;

a second wedge-engagement means engageable with said first slider for holding said first slider at a retracted position; and means for moving said first slider in the retracting direction when a further writing pressure is applied thereto;

whereby when further writing pressure is applied to said first slider through said means for moving said first slider, said first slider is retracted after said second slider has been progressively retracted to said limit means, and said first slider is held retracted while said second slider is released to advance to thereby feed the lead to a writing position.

2. A mechanical pencil as claimed in claim 1 in which said first wedge-engagement means has first rotary elements, the inner wall of said tubular casing means having an inclined guide surface, said first rotary elements being mounted between said inclined guide surface and the outer surface of said second slider, and said second wedge-engagement means has second rotary elements, and a rearwardly spring biased cylindrical body between said first slider and said second slider having an inclined outer surface, said second rotary elements being mounted between the inner surface of said tubular casing means and the inclined outer surface of said cylindrical body.

3. A mechanical pencil as claimed in claim 1 in which said means for moving said first slider comprises a lead guide tube fixed to said first slider and projecting from the forward end of said tubular casing means.

4. A mechanical pencil as claimed in claim 1 further comprising a lead guide tube fixed to the forward end of said tubular casing means, whereby an unexpected retraction of said first slider when an unusually large pressure is applied to said lead guide tube is prevented.

5. A mechanical pencil as claimed in claim 1 in which said second slider projects forwardly of said first slider, and said pencil further comprises a third slider forward of said second slider, and spring means biasing said third slider rearwardly to contact said second slider, and a lead guide tube on said third slider projecting from the forward end of said tubular casing means, whereby when the writing lead does not project from said lead guide tube, successive applications of writing pressure on said lead guide tube and said third slider forcibly retract said second slider in increments, and said means for moving said first slider comprise a projection on said third slider engageable with said first slider when said second slider is at said limit means.

6. A mechanical pencil as claimed in claim 1 in which said chuck mechanism has a forwardly spring loaded chuck, whereby after the application of writing pressure to move said second slider, release of the writing pressure permits said chuck to advance forwardly with the lead engaged therein while said second slider is retained at its incrementally retracted position by said first wedge-engagement means.

7. A mechanical pencil comprising:

a tubular casing means;

a slider axially slidably mounted within said tubular casing means and having a lead guide tube projecting from the writing end of said tubular casing means and a lead retainer for frictionally holding writing lead therein, said slider extending rearwardly and rotatably holding a plurality of rotary elements therein;

a chuck mechanism to the rear of said slider for causing the lead to move forwardly but preventing same from moving rearwardly, said chuck mechanism having a lead engaging chuck axially movably mounted within said tubular casing means, a chuck actuator axially slidably mounted between said tubular casing means and said lead engaging chuck, and a chuck holder extending forwardly toward said slider and having a surface thereon within said slider rotary element engaging; and a cylindrical body having an inclined inner surface and forwardly spring-biased, said cylindrical body being mounted around the outside of said rotary elements for producing a wedge-engagement thereof with the inclined surface of said cylindrical body and said engaging surface of said chuck holder;

whereby when said slider is retracted by a writing pressure and then returned to its forward original position upon release of the writing pressure, said slider is displaced forwardly together with said chuck holder to thereby cause said chuck to travel forwardly and be opened so that succeeding leads can be advanced continuously by said lead retainer.

* * * * *